United States Patent [19]

Kleefeldt et al.

[11] Patent Number: 4,892,339

[45] Date of Patent: Jan. 9, 1990

[54] POWER-CLOSING MOTOR-VEHICLE DOOR LATCH

[75] Inventors: Frank Kleefeldt, Heiligenhaus; Hans T. Menke, Velbert, both of Fed. Rep. of Germany

[73] Assignee: Kiekert GmbH & Co. Kommanditgesellschaft, Heiligenhaus, Fed. Rep. of Germany

[21] Appl. No.: 218,238

[22] Filed: Jul. 12, 1988

[30] Foreign Application Priority Data

Jul. 29, 1987 [DE] Fed. Rep. of Germany ..... 3725075

[51] Int. Cl.[4] ..... E05C 3/26; E05B 47/00

[52] U.S. Cl. ..... 292/201

[58] Field of Search ..... 292/201, 216, 336.3, 292/341.16

[56] References Cited

U.S. PATENT DOCUMENTS

| | | | |
|---|---|---|---|
| 4,395,064 | 7/1983 | Bellat et al. | 292/201 |
| 4,518,180 | 5/1985 | Kleefeldt | 292/201 |
| 4,735,447 | 4/1988 | Kleefeldt | 292/201 X |
| 4,815,775 | 3/1989 | Mertin et al. | 292/201 |

FOREIGN PATENT DOCUMENTS 3150621 6/1983 Fed. Rep. of Germany .

*Primary Examiner*—Richard E. Moore

*Attorney, Agent, or Firm*—Herbert Dubno; Andrew M. Wilford

[57] ABSTRACT

A vehicle door latch for use in combination with a door bolt according to this invention has a housing formed with a horizontally open recess in which the bolt is receivable, a latch fork formed with a fork seat and with at least one detent, and a fork pivot on the housing supporting the fork for pivoting between a locked and a semilocked position with the seat directed vertically away from the fork pivot and the bolt engaged in the seat and an unlocked position permitting the bolt to enter and exit seat and recess. An operating plate pivotal on the housing about an axis substantially parallel to the fork pivot carries the pivot of latch pawl which is pivotal on the link plate into and out of a position engaging the detent and thereby retaining the fork in the semilocked position. A motor connected to the operating plate can pivot same about its axis and, when the pawl is engaged with the detent, pivot and fork into the locked position. A door handle and a link connected between the handle and the pawl can pivot same out of engagement with the detent in any position of the fork.

5 Claims, 3 Drawing Sheets

POWER-CLOSING MOTOR-VEHICLE DOOR LATCH

FILED OF THE INVENTION

The present invention relates to a motor-vehicle door latch. More particularly this invention concerns such a latch which has a motor that is operated to secure the latch.

BACKGROUND OF THE INVENTION

A standard motor-vehicle door latch mounted on an outer door edge has a latching mechanism comprised mainly of a fork that can in a locked position engage around a jamb-mounted bolt and hold the door closed, and that can in an unlocked position release this bolt. The latching mechanism also normally has a pawl that is used to block the fork in the locked position, the fork being spring-loaded to move into the unlocked position when released by this pawl.

When the vehicle door is closed with the fork locked in place by the pawl and itself holding the bolt of the doorpost an annular elastic seal all around the door is pressed against the rim of the door opening. The seal is compressed to prevent leakage in both directions, both to keep water out when it is raining and to prevent the door from whistling when the vehicle is moving at high speed. At today's high travel speeds it is therefore necessary to close the door very tightly, thereby highly compressing the door seal.

Accordingly as described in German patent 3,150,621 filed Dec. 21, 1981 by one of the instant inventors it is known to provide each latch with a motor connected via a crank to an operating member that in turn is directly engageable both with the latch fork and with the pawl. To open the door the operating member pulls the pawl off the fork detent and pivots the fork out to release the bolt and to close the door the operating member moves oppositely to oppositely rotate the fork while allowing the pawl to catch on the detents of the fork. Such a system can close the doors very tightly once the door has been pushed substantially to, that is the power mechanism takes care of the final stages of closure.

The main problem with this system is that if the motor or the vehicle's electric supply fails the door cannot be opened manually. Proposed manual overrides are often complex in the extreme and greatly increase the cost of the latch. In addition the manual override often works in a nonstandard manner, not like just using the standard manual latch handle.

OBJECTS OF THE INVENTION

It is therefore an object o the present invention to provide an improved an improved power motor-vehicle door latch.

Another object is the provision of such a an improved power motor-vehicle door latch which overcomes the above-given disadvantages, that is which is of inexpensive and simple construction yet which can be operated manually in a simple and intuitive manner.

SUMMARY OF THE INVENTION

A vehicle door latch for use in combination with a door bolt according to this invention has a housing formed with a horizontally open recess in which the bolt is receivable, a latch fork formed with a fork seat and with at least one detent, and a fork pivot on the housing supporting the fork for pivoting between a locked and a semilocked position with the seat directed vertically away from the fork pivot and the bolt engaged in the seat and an unlocked position permitting the bolt to enter and exit seat and recess. An operating plate pivotal on the housing about an axis substantially parallel to the fork pivot carries the pivot of a latch pawl which is pivotal on the link plate into and out of a position engaging the detent and thereby retaining the fork in the semilocked position. A motor connected to the operating plate can pivot same about its axis and, when the pawl is engaged with the detent, pivot the fork into the locked position. A door handle and a link connected between the handle and the pawl can pivot same out of engagement with the detent in any position of the fork.

Thus with the system of this invention the operating plate is pivoted to power-close the door, thereby pivoting the pawl and using this pawl to push the fork around into the fully locked position. The user of the latch need merely push the door to into the semilocked position; the motor will take over from here and pull the door fully to into the locked position.

According to a feature of this invention the axis of the operating plate is coaxial with the fork pivot. In this manner the motor force is transmitted with force-multiplying lever action to the fork.

In addition according to this invention the motor carries an orbital crank and a link has one end pivoted on the crank and an other end formed with a slot. A pin on the plate engages in the slot. Thus the plate can move limitedly relative to the link due to the lost motion created by the slot, but the motor will still be able to effectively act virtually directly on the operating plate.

The door handle of the system of this invention is a two-arm lever pivotal on the housing between an open and a closed position and has a lower end provided with a pivot coaxial in the open position with the plate pivot axis. The link is pivoted on the pivot of the handle lower end and provided with an opposite end having a slot and the pawl is provided with a pin engaging in the link slot.

The motor of this system is a small electric motor which, in spite of being a low-wattage unit, can easily pull a door shut with enough force to completely eliminate air or water leaks around it.

DESCRIPTION OF THE DRAWING

The above and other objects, features, and advantages will become more apparent from the following, reference being made to the accompanying drawing in which.

SPECIFIC DESCRIPTION

Figure 1:
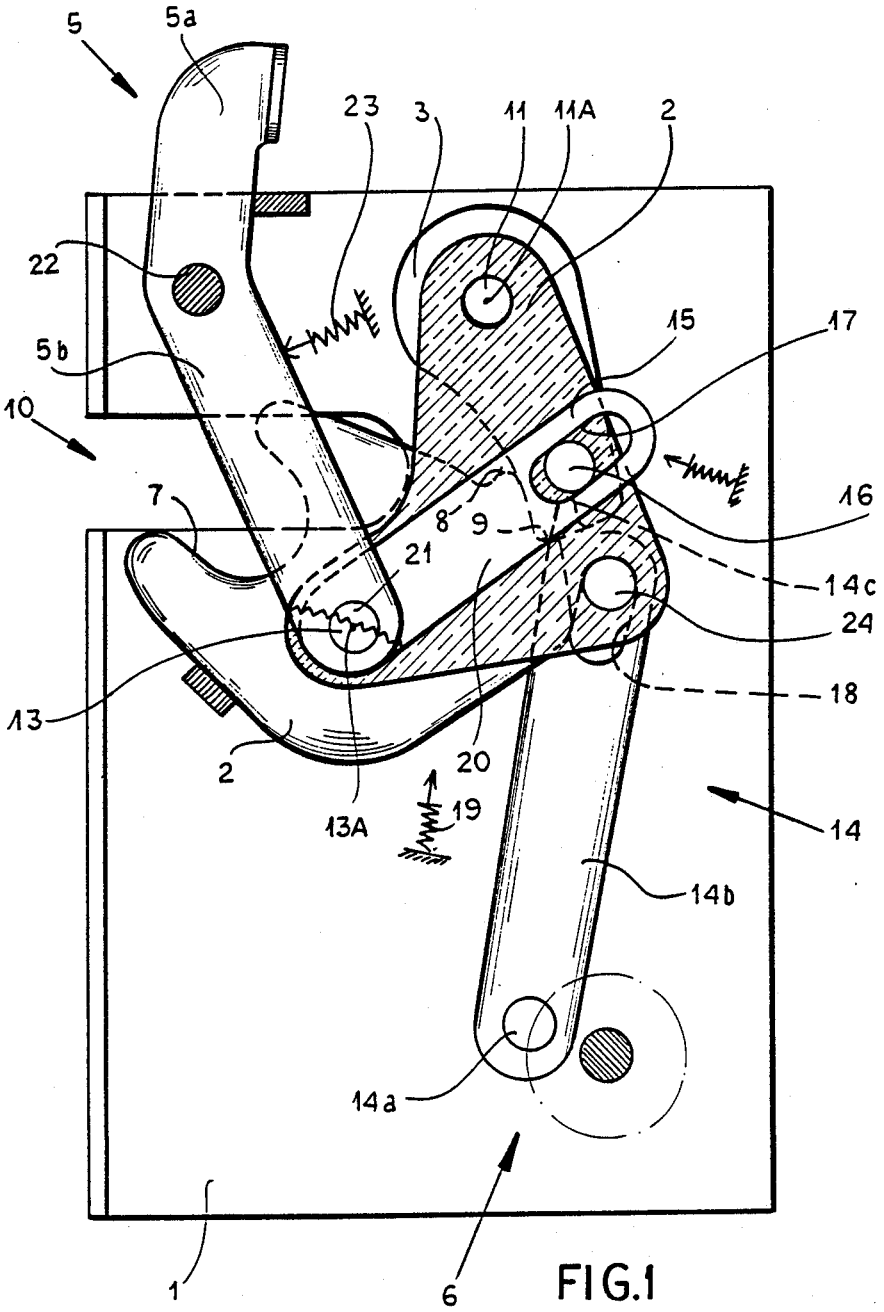
FIG. 1 is a partly sectional side view of the latch according to this invention in the open position.
Figure 2:
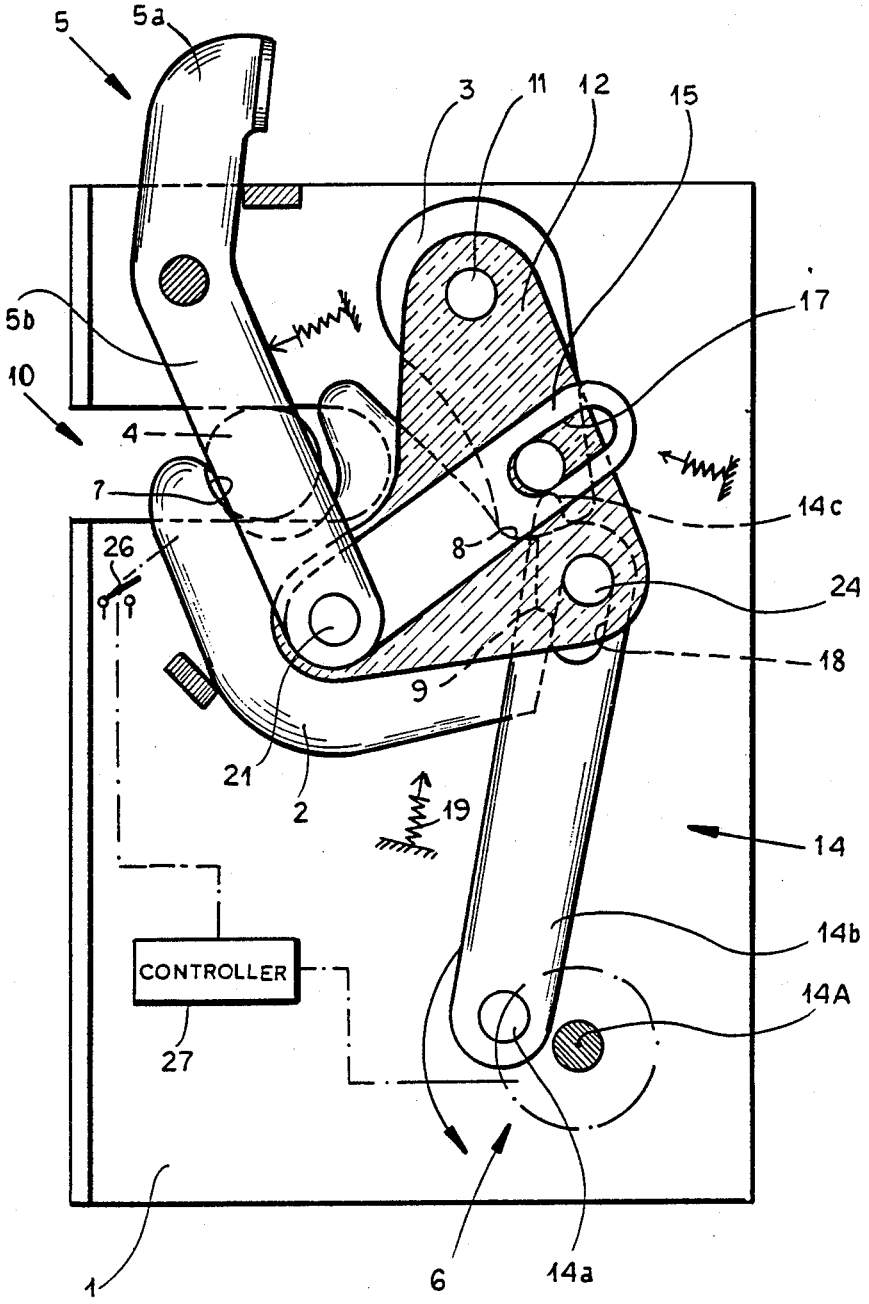
FIGS. 2 and 3 are views like FIG. but respectively showing the latch in the semilatched and fully latched positions.
Figure 3:
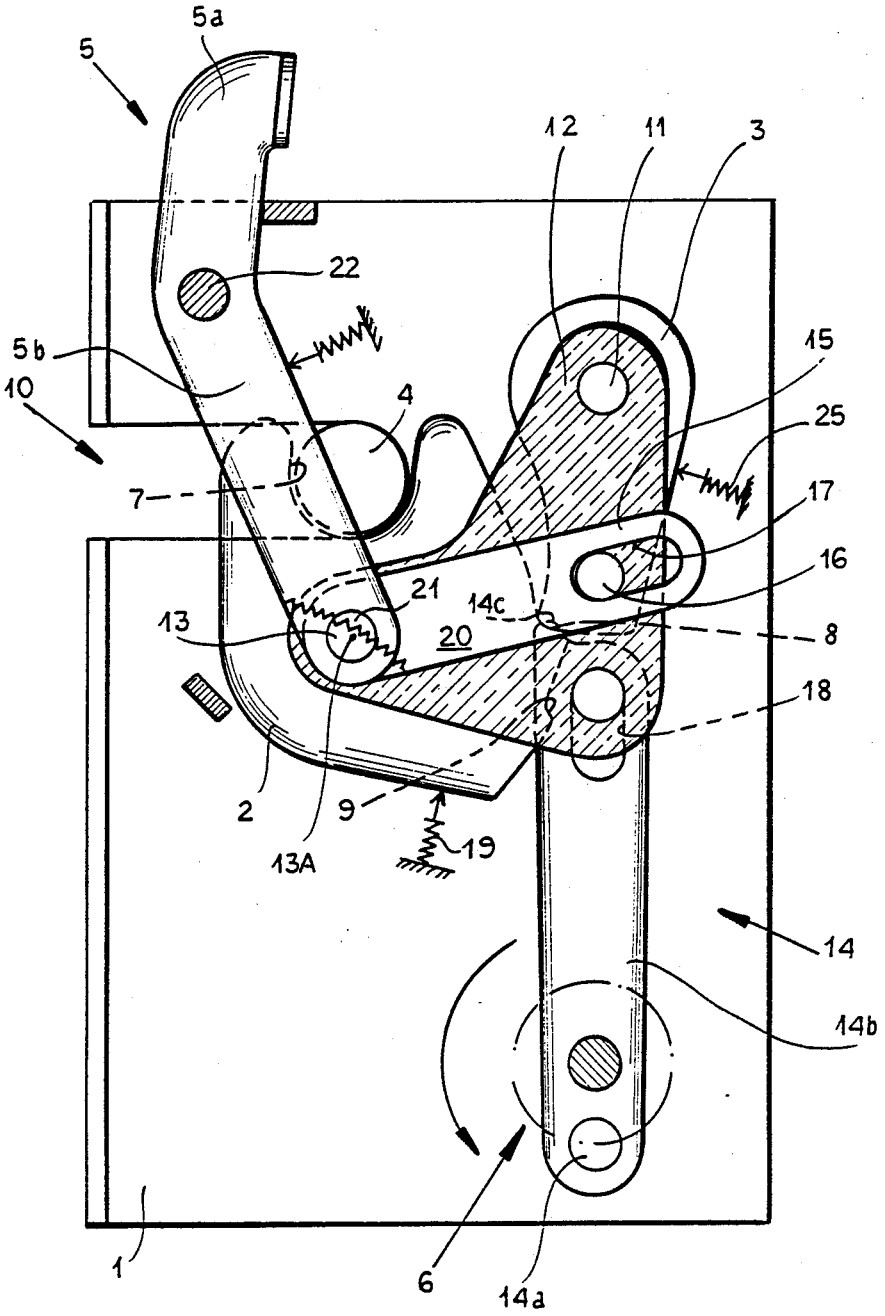

As seen in FIGS. 1 through 3 the latch according to this invention has a housing 1 normally fixed on the edge of a vehicle door and provided with a latch for, 2 that is mounted on a pivot 13 defining a pivot axis 13A that is normally perpendicular to the housing 1, horizontal, and parallel to the direction of travel of the vehicle incorporating the latch. The housing 1 is formed with an outwardly horizontally open notch 10 in which can engage a latch bolt 4 that itself has an enlarged head and that is fixed on the edge of the doorpost. A spring illustrated diagrammatically at 19 normally urges the fork counterclockwise. This fork 2 is formed with a seat 7 into which the bolt 4 can fit.

According to this invention a generally triangular plate 12 is also pivoted on the pin 13 for movement in a plane parallel to that of the fork 2 and itself carries a pawl pivot pin 11 defining a pivot axis 11A and carrying a standard latch pawl 3. The fork 2 has a pair of detents 8 and 9 engageable with the end of the pawl 3 and bearing on same counterclockwise. In addition the pawl 3 is provided with another axially extending pin 16 extending through an unillustrated slot in the plate 12 and engaging in an elongated slot 17 at one end 15 of a link lever 20 connected via a rivet 21 forming another pivot to the lower arm **5*b* of a two-armed release lever 5 that itself is pivoted above the slot 10 at 22 and whose upper arm 5*a* is acted upon by the inner and/or outer door handle. The pivot 21 is coaxial with the pivot 13 in the illustrated unactuated position of the lever 5 which is urged into this position by another diagrammatically illustrated spring 23**.

According to this invention a motor unit 6 is connected via a link assembly 14 to the plate 12 to oscillate it about the axis 13A. More particularly a crank **14*a* orbital about an axis 14A parallel to all of the other parallel axes of the system is pivoted in one end of a link 14*b* having an opposite end formed with a slot 18 in which engages a pin 24 fixed on the plate 12. This slotted end of the link 14*a* is formed with a bump 14*c* that can engage upward against the pawl 3 and push it against the force of its spring 25 out of engagement with either of the detents 8 or 9. This spring 25 also urges the plate 12 up, that is counterclockwise about the pivot 13**.

The mechanism described above functions as follows:

As seen in FIG. 1 when the door is open and the bolt 4 is out of the latch, the fork 2 rests with its back detent 9 engaging the end of the pawl 3 and the crank **14*a* is in such a position that the plate 12 and the pawl 3 carried by it are in their uppermost position, that is with the pin 24 at the upper end of the slot 18**.

Then as the bolt 4 enters the cutout 10 it engages the inner arm of the fork 2 and pivots it back clockwise against the force of its spring 19. This action as shown in FIG. 2 causes the end of the pawl 3 to slide from the back detent 9 to the front detent 8. So far there is no powered action and the door is safely if loosely closed.

Once in this semilatched position a sensor such as the switch indicated schematically at 26 sends a signal to a controller 27 to operate the motor drive 6 and orbit the crank **14*a* through about 120°. This action as shown in FIG. 3 pulls the entire plate 12 down, pivoting it clockwise about the axis 13A by engagement of the pin 24 in the upper end of the slot 18. Since the pawl 3 is mounted on this plate 12, this pushes the pawl 11 down against the detent 8 and also rotates the fork 2 until it pulls the bolt 4 solidly into the extreme back end of the cutout 10. In this position the motor 6 is stopped with the door tightly and effectively latched. The lever action achieved through the plate 12** allows a relatively small motor to exert considerable force to pull in the door with great force.

Further movement of the crank **14*a* about its axis 14A through 270° to return to its starting position will push the nose 14*c* up against the end of the pawl 3 and out of contact with the fork 2. This action will allow the fork 2 to pivot out and will open the door. The slot 18 thus allows the link 14*b* to move up without pushing up the plate 12** at least at the start of its final return rotation.

In addition pushing the upper end of the lever 5 to the left as seen in the drawing will move the link 20 to the right and push the pawl 3 out, thereby also opening the latch. Such opening is equally effective in the semilatched position of FIG. 2 and the fully latched position of FIG. 3 since the pivot 21 is coaxial with the pivot 13.

Thus the door latch of this invention has all the advantages of a power-assisted latch while still operating like a normal manual latch.

I claim:

1. A vehicle door latch in combination with a door belt, the latch comprising:

a door belt;

a housing formed with a horizontally open recess in which the bolt is receivable;

a latch fork formed with a fork seat and with at least one detent;

a fork pivot on the housing supporting the fork for pivoting between a locked and a semilocked position with the seat directly vertically away from the fork pivot and the bolt engaged in the seat and an unlocked position permitting the bolt to enter and exit seat and recess;

an operating plate pivotal on the housing about an operating plate axis substantially parallel to the fork pivot;

a latch pawl pivotal on the operating plate into and out of a position engaging the detentand thereby retaining the fork in the semilocked position;

means including a motor connected to the operating plate for pivoting same means about its axis and, when the pawl is engaged with the detent, pivoting the fork into the locked position; and a door handle and a link connected between the handle and the pawl for pivoting same out of engagement with the detent in any position of the fork.

2. The door latch defined in claim 1 wherein, the axis of the operating plate is coaxial with the fork pivot.

3. The door latch defined in claim 1 wherein the means includes an orbital crank carried by the motor and a link having one end pivoted on the crank and an other end formed with a slot, the plate having a pin engaging in the slot.

4. The door latch defined in claim 1 wherein the door handle is pivotal on the housing between an open and a closed position and has a lower end provided with a pivot coaxial in the open position with the plate pivot axis, the link being pivoted on the pivot of the handle lower end and provided with an opposite end having a slot, the pawl being provided with a pin engaging in the link slot.

5. The door latch defined in claim 1 wherein the motor is an electric motor.

* * * * *